US005340323A

United States Patent [19]

Imanishi et al.

[11] Patent Number: 5,340,323

[45] Date of Patent: Aug. 23, 1994

[54] COIL SPRING ENGAGEMENT CONSTRUCTION OF A HIGH TENSION TERMINAL IN AN ENGINE IGNITION APPARATUS

[75] Inventors: Hisao Imanishi; Keiichi Nakajima, both of Yokkaichi, Japan

[73] Assignee: Sumitomo Wiring Systems, Ltd., Yokkaichi, Japan

[21] Appl. No.: 6,989

[22] Filed: Jan. 21, 1993

[30] Foreign Application Priority Data

Jan. 29, 1992 [JP] Japan ..... 4-014018
Feb. 14, 1992 [JP] Japan ..... 4-005911[U]

[51] Int. Cl.[5] ..... H01R 4/48
[52] U.S. Cl. ..... 439/125; 439/840
[58] Field of Search ..... 439/125-128, 439/843, 846, 844, 845, 841, 840; 123/169 PA, 169 PH

[56] References Cited

U.S. PATENT DOCUMENTS 1,933,304 10/1931 Bell .
5,163,838 11/1992 Tura, Jr. et al. ..... 439/126

FOREIGN PATENT DOCUMENTS 851563 1/1940 France ..... 439/843
2492596 4/1982 France ..... 439/126
233473 2/1990 Japan .
347475 2/1991 Japan .
3105072 5/1991 Japan .
270038 5/1970 U.S.S.R. ..... 439/841

OTHER PUBLICATIONS

English Language abstract of Japanese Laid-Open Publication No. 3-47474.
English Language abstract of Japanese Laid-Open Publication No. 2-33473.
English Language abstract of Japanese Laid-Open Publication No. 3-105072.

*Primary Examiner*—Gary F. Paumen
*Attorney, Agent, or Firm*—Sandler Greenblum & Bernstein

[57] ABSTRACT

In an insertion and engagement operation of a coil spring into the high tension terminal, the insertion end portion of the coil spring is inclined so that the projection portions may be located at upper and lower positions, and the outer diameter of the projection portions is approximately the same diameter as the outer diameter of the coil spring. The engagement portion of the high tension terminal includes an engagement hole, so that it can be visually confirmed that the insertion terminal portion of the coil spring has been engaged, the insertion end portion of the coil spring having been inclined in advance.

5 Claims, 6 Drawing Sheets

COIL SPRING ENGAGEMENT CONSTRUCTION OF A HIGH TENSION TERMINAL IN AN ENGINE IGNITION APPARATUS

BACKGROUND OF THE INVENTION

The present invention generally relates to a high tension terminal in an engine ignition apparatus to be directly connected with an ignition plug of an engine, and more particularly, to improvements in the engagement construction of the coil springs to be inserted into the interior of the high tension terminal.

Conventionally, an ignition apparatus of the engine is provided wherein a high tension terminal 2 is located within the high tension power source 1. Conductive coil springs 5 for or electrically connecting the high tension terminal 2 with the top terminal 4 of the ignition plug 3 are inserted into the interior of the high tension terminal 2, as disclosed within Japanese Patent Laid-Open Publication No. 3-47475.

The above described coil springs are required to engage the insertion end portion 5*a* with the high tension terminal 2 to an extent so that the coil springs may not naturally drop. As shown in detail in FIG. 18 (A), an annular engagement concave groove 2*a* is provided on the peripheral face of the cylindrical portion of the high tension terminal 2, and also, the outer diameter d1 of the insertion end portion 5*a* of the coil spring 5 is made larger in diameter (d1>d2) than the outer diameter d2 of the coil spring 5. The insertion end portion 5*a* is inserted into the interior of the high pressure terminal 2 while the insertion end portion 5*a* is being contracted in diameter by the rotation in a reverse direction to the winding direction so that the insertion end portion 5*a* is adapted to be engaged with the engagement concave groove 2*a*. It was difficult to insert the insertion end portion 5*a* of a larger diameter than the coil spring 5 into the interior of the high tension terminal 2 so that the inserting operation was inferior. Also, it could not be visually recognized that the insertion end portion 5*a* of the coil spring 5 was engaged into the engagement concave groove 2*a* of the high tension terminal 2.

As shown in FIG. 18 (B), there is also a method of inserting the coil spring 5 into the interior of the high tension terminal with the inserting end portion 5*a* of the coil spring 5 being made the same diameter as the outer diameter d2 of the coil spring 2, thereafter drawing out, or inwardly projecting one portion of the outer peripheral wall of the high tension terminal 2, and engaging the insertion end portion 5*a* with the drawn out portions 2*b*, 2*b*.

When the insertion end portion 5*a* is engaged with the above described drawn out portions 2*b*, 2*b*, it is necessary to effect a drawing out working operation at another step after the insertion of the coil spring 5. When the bending of the inner portion side of the drawn out portion is small, and inconsistencies exist in the vertical direction of the spring, springs are often invisible through the gaps of the drawn out portion, with a problem that the spring engagement is hard to visually confirm from the outside.

SUMMARY OF THE INVENTION

Accordingly, the present invention has been developed with a view to substantially eliminate the above discussed drawbacks inherent in the prior art, and has for its essential object to provide an improved coil spring engagement construction of a high tension terminal in an engine ignition apparatus.

Another important object of the present invention is to provide an improved coil spring engagement construction of a high tension terminal in an engine ignition apparatus in which one can easily insert and engage the coil springs into the high tension terminal, is capable of seeing the engagement condition from the outside, and besides, can be manufactured at a lower price.

In accomplishing these and other objects, according to one preferred embodiment of the present invention, in an engine ignition apparatus where a conductive coil spring for electrically connecting the top terminal of the ignition plug with the above described high tension terminal is inserted into the high tension terminal upon which the high voltage is applied, a coil spring engagement construction of the high tension terminal in the engine ignition apparatus includes engagement portions composed of holes and/or concave grooves for engaging the insertion and portions of the above described coil springs on the cylindrical peripheral wall of the above described high tension terminal. Projection portions project at a larger diameter than the coil spring outer diameter, are engaged by the engagement portions of the above described high tension terminal on both the sides in the axial orthogonal direction of the insertion end portions in the above described coil springs. Both these projection portions are shifted in position in the vertical direction at the time of insertion of the cylindrical portion of the high tension terminal and the diameter formed is made almost the same as the coil spring outer diameter.

The projection portion of the insertion end portion of the above described coil spring is inclined in advance so as to become upper and lower positions at the time of insertion of the terminal so that the projection portion is adapted not to be projected outwards from the outer diameter of the coil spring. In the engagement, portion of the terminal, the inclined angle is changed or the angle is made horizontal so that the projection portion projects from the coil spring outer diameter to effect the engagement in the above described engagement portion.

The above described oval portion is obliquely inserted at the same time as the above described terminal with the section of the insertion end portion of the above described coil spring being made oval in shape so that both the side portions project as a projection portion with the angle being made horizontal in the above described engagement portion. At least one of a pair of engagement portions provided on the terminal side for engagement of both the side projection portions of the above described coil spring is composed of a hole. The hole is shaped so that the engaged oil spring may be visually seen from the outside. When the insertion end portion of the coil spring is inclined so that the projection portion may be located at upper and lower positions in the coil spring engagement construction of the present invention, the outer diameter of the projection portion becomes approximately the same in diameter as the outer diameter of the coil spring, so that the insertion end portion can be easily inserted into the high tension terminal. The inclination angle of the inclined insertion end portion is changed and is engaged by the engagement portion of the high insertion terminal or is horizontally restored and engaged. The coil spring is inserted and engaged by a one touch operation in this manner so as to improve the operation.

When the engagement portion of the above described high tension terminal is composed of a hole, it can be visually confirmed from the outside that the insertion end portion of the coil spring has been engaged with the engagement portion.

When the insertion end portion of the coil spring is kept inclined in advance, the trouble of an inclination operation before the insertion is made unnecessary. In accomplishing these and other objects, according to one preferred embodiment of the present invention, in an engine ignition apparatus where a conductive coil spring for electrically connecting the top terminal of the ignition plug or the ignition coil with the above described high tension terminal is inserted and disposed in the insertion hole of the high tension terminal upon which the high tension is applied, the projection for engaging the insertion end portion of the above described coil spring is provided at an angle other than 180 degrees on the same circumference of the insertion hole peripheral wall of the above described high tension terminal. Each projection is formed in a narrowing grade towards the interior from the opening direction of the above described insertion hole. The coil spring of approximately the same outer diameter is inserted into the insertion hole and climbs over the above described projections for engagement. It is desirable that projections provided on the same circumference should be provided at two locations, and that the projections may be formed from one spring projected in the given angle range. The above described projections can be provided at an angle of 180 degrees in a position of approximately the same size or smaller than the inner diameter size of the insertion hole from the insertion opening of the insertion hole on the same circumference of the above described insertion hole peripheral wall.

When the insertion end portion of the coil spring is inserted into the insertion hole of the high tension terminal in the coil spring engagement construction of the present invention, the insertion end portion collides against the projection if the projection is at angle other than 180 degrees. The insertion end portion is naturally inclined so that the wider angle of the projection projects downwardly and the narrower angle of the projection may project upwardly with the respective projections as support points. As the outer diameter of the insertion end portion becomes approximately the same diameter as the inner diameter provided between the projection and the insertion hole by the inclination, the insertion end portion climbs over the projection and can be inserted. When the insertion end portion passes the projection, the coil spring is horizontally restored by the elastic force and is adapted to be engaged with the projection. The coil spring of the same outer diameter can be inserted and engaged with a one touch operation in this manner, thus improving the operation.

When the above described projection is provided at an angle of 180 degrees, the insertion end portion of the coil spring can be inserted while being inclined in advance by the provision of the projection in the particular position. In this manner, the coil spring of the same outer diameter can be inserted, and engaged with a one touch operation.

BRIEF DESCRIPTION OF THE DRAWINGS

These and other objects and features of the present invention will become apparent from the following description taken in conjunction with the preferred embodiment thereof with reference to the accompanying drawings, in which.

Figure 2:
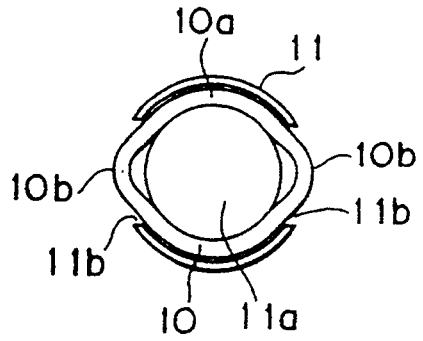
FIG. 2 is a plan sectional view of FIG. 1.
Figure 11:
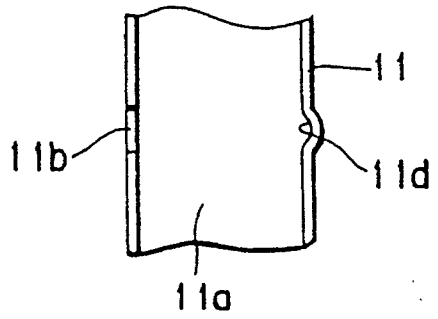
Figure 12A:
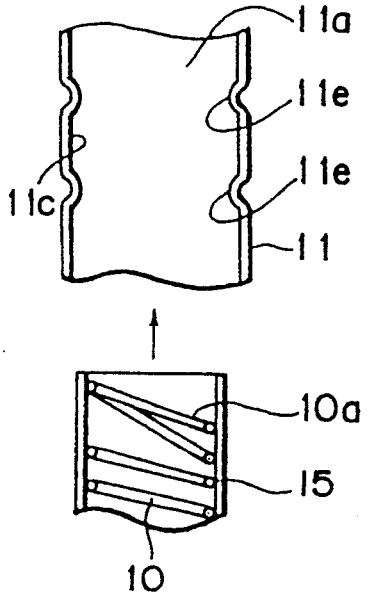
Figure 12B:
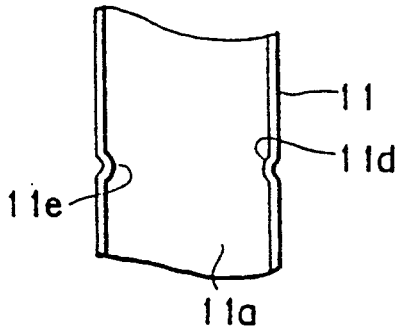
Figure 13:
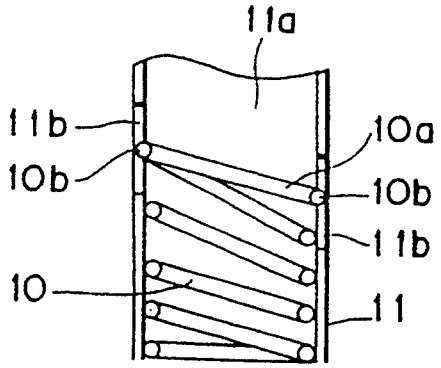
Figure 14:
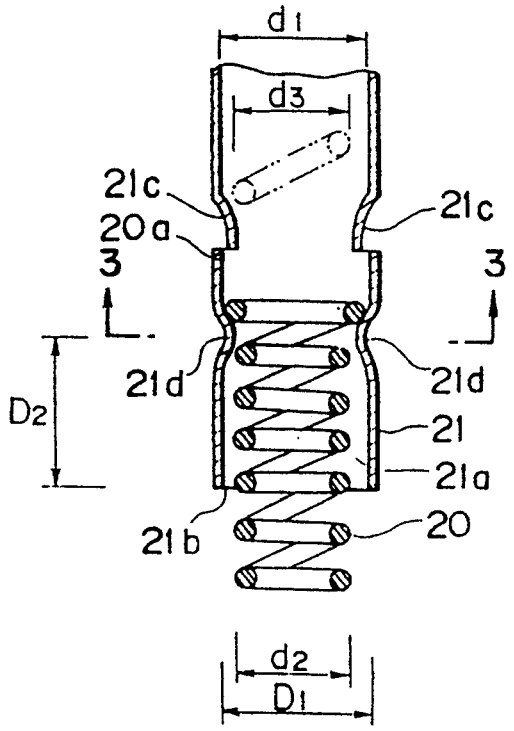
Figure 15:
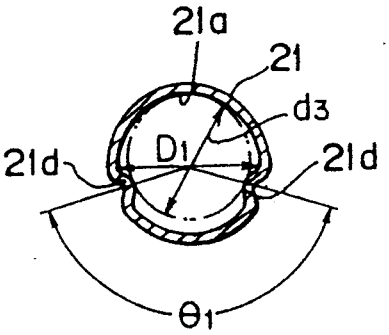
Figure 15:
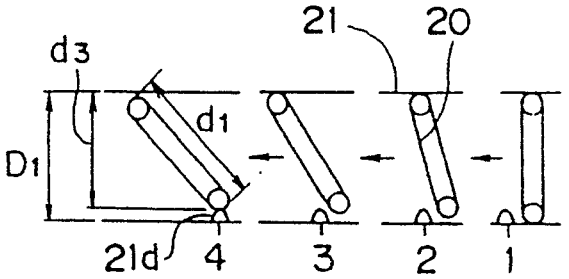
Figure 16:
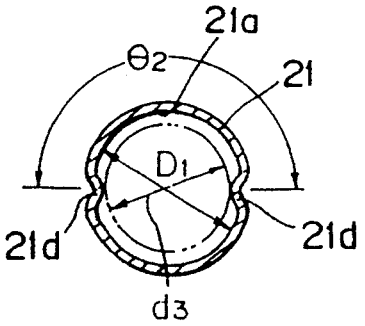
Figure 17:
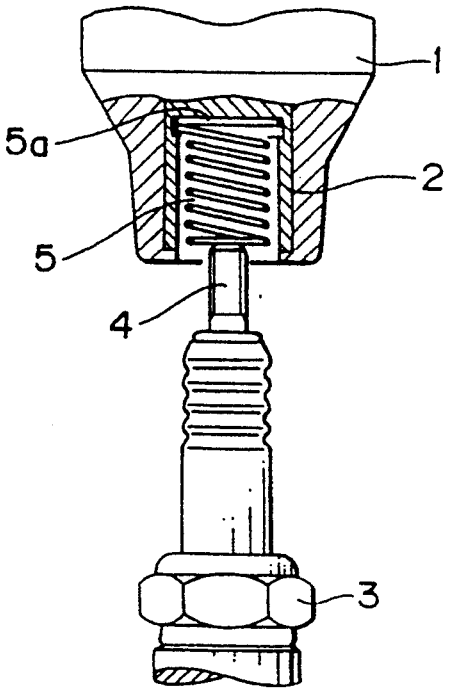
Fig 17. PRIOR ART
Figure 18A:
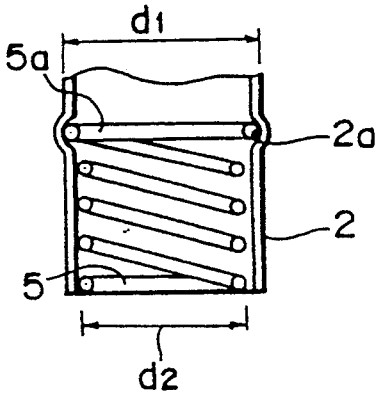
Fig. 18(A) PRIOR ART
Figure 18B:
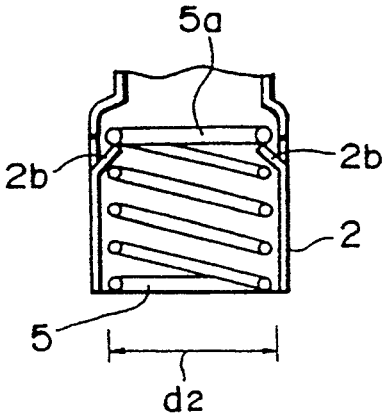
Fig. 18(B) PRIOR ART

FIGS, 10 (A) and 10(B) are side sectional views, each showing a modified embodiment of the engagement portion to be provided at the terminal;

FIG. 11 is a side sectional view showing a modified embodiment of the engagement portion of the terminal;

FIGS. 12 (A) and 12(B)are side sectional views, each showing a modified embodiment of the embodiment portion in the terminal;

FIG. 13 is a side sectional view showing a modified embodiment of the engagement construction of a coil spring;

FIG. 14 is a side sectional view of a coil spring engagement construction in a second embodiment of the present invention;

FIG. 15 (A) is a sectional view taken along line 3—3 of FIG. 14 in a second embodiment, and FIG. 15(B) is an operation illustrating view;

FIG. 16 is a sectional view similar to FIG. 2 of the second embodiment of the present invention;

FIG. 17 is a side sectional view of a conventional engine ignition apparatus; and FIGS. 18 (A) and 18(B) are side sectional views, each showing the conventional coil spring engagement construction.

DETAILED DESCRIPTION OF THE INVENTION

Before the description of the present invention proceeds, it is to be noted that like parts are designated by like reference numerals throughout the accompanying drawings.

FIRST EMBODIMENT

Figure 1:
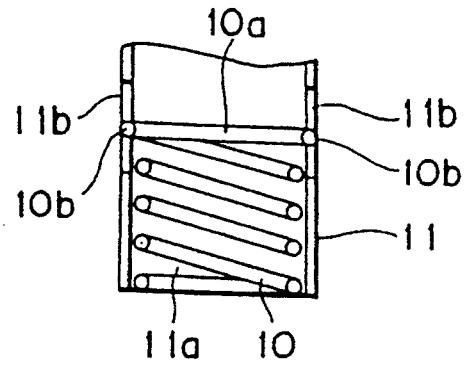
FIG. 1 is a side sectional view of the coil spring engagement construction of the present invention.
Figure 3:
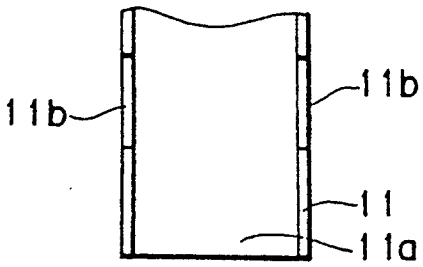
FIG. 3 is a side sectional view of a high tension terminal.
Figure 4:
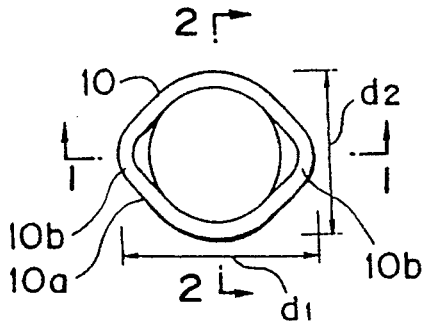
FIG. 4 is a plan view of the coil spring in FIG. 1.
Figure 5:
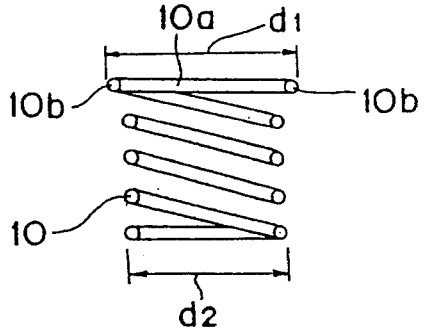
FIG. 5 is a sectional view taken along line 1—1 of FIG. 4.
Figure 6:
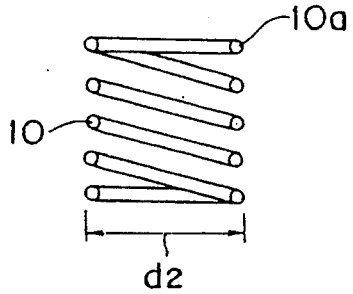
FIG. 6 is a sectional view taken along line 2—2 of FIG. 4.
Figure 7:
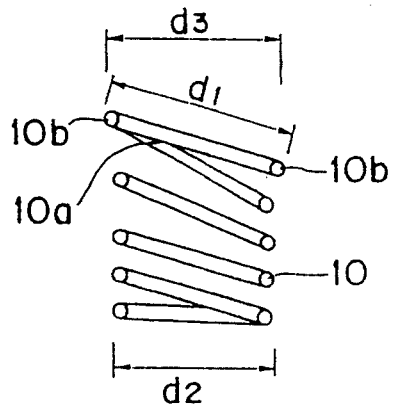
FIG. 7 is a side sectional view showing a condition at the time of terminal insertion of the above described coil spring.

FIG. 1 through FIG. 7 show a first embodiment of the present invention. FIG. 1 and FIG. 2 show a condition where coil springs 10 are engaged with terminals 11. FIG. 3 shows terminals 11, FIG. 4 through FIG. 6 show coil springs 10, and FIG. 7 show a condition where the coil springs 10 are not inserted into the terminal.

The above described coil spring 10 is wound in a true circle helical shape with a given pitch and a given outer diameter d2 as in the conventional coil spring 5.

Projection portions **10*b*, 10*b*, which project outwards to a larger diameter d1 than the outer diameter d2 of the coil spring 10, are provided on both the sides in the axial orthogonal direction of the insertion end portion 10*a*, as seen in FIG. 4, in the insertion end portion 10***a* of the coil spring 10. The insertion end portion 10*a* becomes oval-shaped as shown in FIG. 4 by projection portions 10*b*, 10*b*.

Figure 8A:
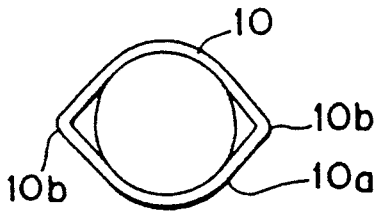
FIGS. 8 (A) and 8(B) are plan views, each showing a modified embodiment of the insertion end portion of the coil spring.
Figure 8B:
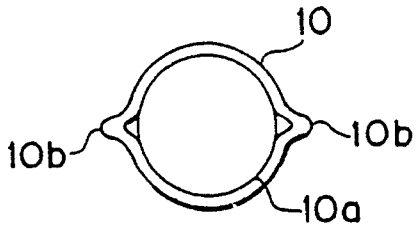

The insertion end portion 10*a* may be made in a diamond shape as in FIG. 8 (A), or a projection shape as in FIG. 8 (B) instead of the above described oval shape. Moreover, any insertion end portion 10*a* having projection portions on both side portions will be sufficient.

Figure 9A:
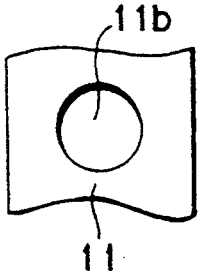
FIGS. 9 (A), 9(B), and 9(C) are side views, each showing a modified embodiment of an engagement portion to be provided in the terminal.
Figure 9B:
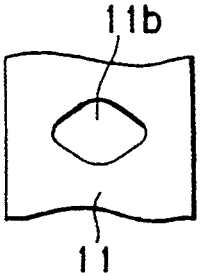
Figure 9C:
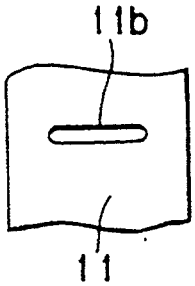

As shown in FIG. 3, a high tension terminal 11 has a cylindrical shape with an insertion hole 11*a* of a diameter slightly larger than the outer diameter d2 of the coil spring 10 as in the conventional high tension terminal 2. Engagement holes 11*b*, 11*b* which engage the projection portions 10*b*, 10*b* of the insertion end portion 10*a* of the above described coil spring 10 are opened in a predetermined position of the outer peripheral wall of the high pressure terminal 11. The engagement holes 11*b*, 11*b* may be of a true circle as shown in FIG. 9 (A), an oval shape as shown in FIG. 9 (B), or a slit shape as shown in FIG. 9 (C).

When the coil spring 11 is inserted and engaged into the terminal 10 of the above described construction, the insertion end portion 10*a* of the coil spring 10 is inclined so that the projection portions 10*b*, 10*b* may become upper and lower with respect to each other in position before the coil spring 10 is inserted. Thus, the outer diameter d1 of the insertion end portion 10*a* with respect to the outer diameter d2 of the coil spring 10 becomes smaller by the inclined portion as shown in FIG. 7. As the outer diameter d3 becomes approximately the same as the outer diameter d2 of the coil spring 10, the insertion into the insertion hole 11*a* of the high tension terminal 11 can be effected easily.

When the projection portions 10*b*, 10*b* of the insertion end portion 10*a* of the coil spring 10, which are inserted obliquely into the insertion hole 11*a* of the above described high tension terminal 11, are in conformity with the engagement holes 11*b*, 11*b*, the projection portions 10*b*, 10*b* are restored into a horizontal condition from the inclined condition by the elastic force as shown in FIG. 1 and FIG. 2 so as to engageably fix the projection portions 10*b*, 10*b* into the engagement holes 11*b*, 11*b* so that the coil spring 10 will not naturally drop from the high tension terminal 11.

The operation is improved, because the coil spring 10 can be inserted and engaged into the high tension terminal 11 with a one touch operation. It can be visually confirmed from the engagement holes 11*b*, 11*b* of the high tension terminal 11 from the outside that the projection portions 10*b*, 10*b* of the insertion end portion 10*a* of the coil spring 10 have been engaged with the engagement holes 11*b*, 11*b*.

Figure 10A:
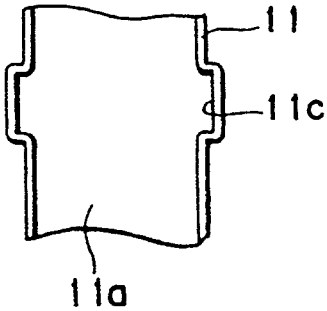
Figure 10B:
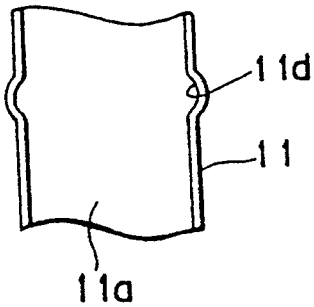

The high tension terminal 11 in the above described first embodiment has opened engagement holes 11*b*, 11*b* which can be visually seen from the outside. An engagement concave groove 11*c*, which is elongated in a vertical direction as shown in FIG. 10 (A), or a semi-circular engagement concave groove 11*d*as shown in FIG. 10 (B) may be provided if the visual confirmation is not required. The projection portions 10*b*, 10*b* of the insertion end portion 10*a* of the coil spring 10 which has been inserted obliquely can be restored in a horizontal condition especially if the high tension terminal has a long engagement concave groove 11*c* shown in FIG. 10 (A).

The visual confirmation can be effected if an engagement hole 11*b*, and an engagement concave groove 11*d* are provided respectively on each side of the high tension terminal 11 as shown in FIG. 11.

The engagement concave grooves 11*c*, 11*d* of the high tension terminal of the above described FIGS. 10 (A), 10(B) and 11 are formed respectively by an outward embossing operation on the inner face of the peripheral wall. The outer face of the peripheral wall can be inwardly embossed so that the engagement concave grooves 11*c*, 11*d* can be formed as shown in FIG. 12 (A) and FIG. 12 (B). It is preferable for the coil spring 10 to be accommodated in a sleeve shaped jig 15 of a diameter smaller than the inner diameter of the embossed projections 11*e*, 11*e* so as to effect an inserting operation for prevention of the projection portions 10*b*, 10*b* of the insertion end portion 10*a* from being caught in the embossed projections 11*e*, 11*e* at the time of insertion of the coil spring 10.

The insertion end portion 10*a* of the coil spring 10 is inclined in advance so that the projection portions 10*b*, 10*b* may become upper and lower in position as shown in the above described FIG. 7, and the bother of inclining the insertion end portion 10*a* is made unnecessary before the insertion, so that the inserting operation can be quickly effected.

The engagement holes 11*b*, 11*b* of the high tension terminal 11 may be shifted in the upper and lower positions as shown in FIG. 13 in accordance with the inclined angle of the projection portions 10*b*, 10*b* and changed in the no-load condition.

The projection portions 10*b*, 10*b* of the coil spring have only to be projected from the outer diameter in the horizontal direction or the inclined condition at the no-load condition, and the engagement portion, to be formed at the terminal where the projection portions are engaged, has only to be formed in a position where the projection portion to be projected in the above described no-load condition is engaged.

The engagement portion to be formed on the terminal will be sufficient if the projection portion of the coil spring is engaged enough to hook the inner edge of the hole with respect to the dropping direction. When the engagement portion is short, it is desirable to provide a stopper which becomes a stopper on the terminal inner face an the coil spring compression side in the reverse direction.

As is clear from the foregoing description, according to the arrangement of the present invention, the insertion end portion of the coil spring is inclined so that the projection portion may become upper and lower in position and is made smaller than the inner diameter of the cylindrical terminal at the time of inserting the terminal in the coil spring engaging construction of the coil spring of the high tension terminal of the present invention, so that the inserting operation can be smoothly effected. Since the outer diameter of the projection portion of the coil spring projects in the engagement portion provided on the terminal, the coil spring can be inserted and engaged into the high tension terminal with a one touch operation, and the operation can be improved.

If the engagement portion of the high tension terminal includes a hole, it can be visually confirmed that the insertion end portion of the coil spring has been engaged with the engagement portion.

SECOND EMBODIMENT

The coil spring 10 is wound in a true circular helical shape with a given pitch and a given outer diameter d2 as shown in FIG. 14 and FIG. 15(B).

A high tension terminal 21 has a cylindrical shape having an insertion hole 21*a* formed on the inner diameter D1. The diameter D1 is slightly larger than the outer diameter d2 of the coil spring 20 as in the conventional high tension terminal 2.

Stoppers 21*c*, 21*c* are inwardly embossed so that the diameter may become smaller than the inner diameter D1 of the insertion hole 21*a* in two or more locations on the same circumference portion, on the peripheral wall in a position deeper than the insertion opening 21*b* of the high tension terminal 21.

Projections 21*d*, 21*d* for engaging the insertion end portion 21*a* of the above described coil spring 20 are provided at an angle Θ1 (for example, 150 degrees) other than 180 degrees, in two locations on the same circumference on the peripheral wall at a position shallower than the insertion opening 21*b* of the above described high tension terminal 21.

Each of the projections 21*d*, 21*d* is formed at an incline inwardly of the insertion hole 21*a*. The position of each projection 21*d*, 21*d* is provided in a position deeper than the length of the above described inner diameter D1 from the tip end of the insertion opening 21*b*.

The insertion end portion 20*a* of the coil spring 20 is inserted into the insertion hole 21*a* from the insertion opening 21*b* of the high tension terminal 21 so as to engageably insert the coil spring 21 into the high tension terminal 21 of the above described construction. when the insertion end portion 10*a* abuts against projections 21*d*, 21*d* as shown in the 1 to 4 positions of FIG. 15 (B), the wider angles of the projections 21*d*, 21*d* become downwardly located, and the narrower angles thereof become upwardly located as shown in the two dot chain lines in FIG. 15 (A) with the projections 21*d*, 21*d* as support points. The insertion end portion 21*a* is naturally inclined without change in the outer diameter d2 of the coil spring 20.

The insertion end portion 20*a* climbs over the projections 21*d*, 21*d* while being guided by the inclines of the projections 21*d*, 21*d* and is smoothly inserted.

As the insertion end portion 21*a* is horizontally restored by its elastic force when the insertion end portion 21*a* passes the projection 21*d*, 21*d*, the diameter becomes the outer diameter d2 and is of a diameter larger than the inner diameter d3 between the above described projections 21*d*, 21*d* and the insertion hole 21*a*. The coil spring 20 is engaged by the projection 21*d*, 21*d* so that the coil spring 20 is prevented from naturally dropping from the high tension terminal 21.

As the coil spring 20 can be easily inserted into and engaged with the high tension terminal 21 with a one touch operation, the operation is improved.

FIG. 16 is an example where projections 21*d*, 21*d* of the above described high tension terminal 21 are provided at an angle 02 of 180 degrees. In this case, the projections 21*d*, 21*d* are desirably provided in a position of the diameter size D2, or lower, which is the same as the inner diameter D1 of the insertion hole 21*a*. As the insertion end portion 20*a* of the coil spring 20 is hard to incline naturally because of the projections 21*d*, 21*d* in this construction, the insertion end portion 10*a* can be inserted while being inclined in advance.

As is clear from the foregoing description, according to the arrangement of the present invention, the insertion end portion can be inserted while smoothly climbing over the projections, because the insertion end portion of the coil springs is automatically inclined by the projections provided in the insertion hole of the high tension terminal. The coil spring engagement construction of the high tension terminal of the present invention includes the outer diameter of the insertion end portion being adapted to be made approximately the same in diameter as the inner diameter between the projection and the insertion hole of the high tension terminal. In this manner, the coil spring can be inserted into and engaged with a one touch operation, thus improving the operation. As the high tension terminal can be worked into the cylindrical shape with a conductive plate material, that the coil spring engagement construction can be made at a lower cost.

Although the present invention has been fully described by way of example with reference to the accompanying drawings, it is to be noted here that various changes and modifications will be apparent to those skilled in the art.

Therefore, unless such changes and modifications depart from the scope of the present invention, they should be construed as included therein.

What is claimed is:

1. A coil spring engagement construction of a high tension terminal in an engine ignition apparatus including a conductive coil spring for electrically connecting a top terminal of an ignition plug with a high tension terminal, said coil spring being inserted within the high tension terminal upon which the high tension is applied, said coil spring including an insertion end portion, said coil spring engagement construction comprising engagement portions on said high tension terminal including at least one of holes and concave grooves in a wall thereof for engaging an insertion end portion of the coil spring on a cylindrical peripheral wall of the high tension terminal, projection portions of said insertion end portion projecting outwardly to a diameter larger than the coil spring outer diameter to be engaged by the engagement portions of the high tension terminal, said projection portions being located on both sides of the insertion end portion of the coil spring.

2. A coil spring engagement construction defined in claim 1, wherein said insertion end portion is oval and the ends of the oval form said projection portions.

3. A coil spring engagement construction defined in claim 1, wherein said engagement portions each comprise a hole, each hole being shaped so that the engaged coil spring may be seen from the outside.

4. A coil spring engagement construction defined in claim 1, wherein said engagement portions are provided at an angle other than 180 degrees apart on the same circumference of a peripheral wall of the high tension terminal, each engagement portion inwardly projecting from said peripheral wall, whereby the coil spring is inserted into the high tension terminal, said projection portions climbing over the engagement portions for engagement therewith.

5. A coil spring engagement construction defined in claim 1, wherein said engagement portions are provided 180 degrees apart, said engagement portions projecting inwardly from a peripheral wall of said high tension terminal, whereby an end of the coil spring is inserted into the high tension terminal, said projection portions climbing over the engagement portions for engagement therewith.

* * * * *